United States Patent [19]

Peralta

[11] Patent Number: 5,026,519

[45] Date of Patent: Jun. 25, 1991

[54] METHOD OF MAKING TUNGSTEN POWDER COMPACTS

[75] Inventor: Roselin E. Peralta, Athens, Pa.

[73] Assignee: GTE Products Corporation, Stamford, Conn.

[21] Appl. No.: 600,377

[22] Filed: Oct. 19, 1990

[51] Int. Cl.[5] ..... B22F 1/00

[52] U.S. Cl. ..... 419/30; 419/36; 419/68

[58] Field of Search ..... 419/30, 36, 68

[56] References Cited

U.S. PATENT DOCUMENTS 4,971,757 11/1990 Day et al. ..... 419/49

*Primary Examiner*—Stephen J. Lechert, Jr.

*Attorney, Agent, or Firm*—Robert E. Walter

[57] ABSTRACT

According to a method for making a compact consisting essentially of pure tungsten metal powder, the tungsten metal powder is contacted with an aqueous acid mixture at a sufficient concentration and for a sufficient period of time to etch the surface of the powder and the resulting powder is isostaticly pressed at an ambient temperature at a pressure of from about 18,000 to about 20,000 psi. for a sufficient period of time to form a compact.

1 Claim, No Drawings

METHOD OF MAKING TUNGSTEN POWDER COMPACTS

BACKGROUND OF THE INVENTION

The present invention is directed to powder compacts formed from tungsten powder without the aid of organic binders to impart green strength.

Tungsten powders are typically formed into sintered parts by first cold isostaticly forming a compact of the part and then sintering the compact to final density. According to one technique, prior to cold isostatic pressing, the powder may be mixed with an organic binder to impart green strength to the compact so it can be handled before sintering. According to another technique, it is also known that high cold isostatic pressing, on the order of 35,000 lbs/sq. inch can result in a compact having sufficient green strength for subsequent handling. Although lower pressures have been utilized, it is difficult to achieve consistent results at low pressures with certain tungsten powders.

More particularly, commercially available M-55 tungsten powder commercially available from the Chemical and Metallurgical Division, GTE Product Corporation, Hawes Street, Towanda, Pa. 18848, may be compacted at pressures over 35,000 psi. However, it is difficult to compact the powder if the pressure used only reaches 18,000 psi. Since some customers have presses that can produce only 18,000 psi, any improvement which lowers the pressures needed for compaction would be desirable.

It is known to wash tungsten powder in acids such hydrofluoric acid to remove the surface impurity layers from the powder particles to facilitate the process of sintering and formation of stronger bonds between the powder particles. See Institute of Technical Physics, Hungarian Academy of Sciences, Institute of Metallurgy, Academy of Sciences of the USSR, Translated from Poroshkovaya Metallurgiya, No. 6(294), pp. 4–11, Jun. 1987, Original article submitted Mar. 12, 1986. Also, according to U.S. Pat. No. 4,101,309 to Isamu et al, it is known to wash tungsten powders with hydrochloric acid and hydrofluoric acid for obtaining a material, such as a wire, having a low high temperature deformation.

Heretofore, typical prior processes for making substantially pure tungsten powder compacts without the aid of organic binders to impart green strength have utilized relatively high pressures during isostatic pressing of the tungsten powder to achieve consistent results with difficult to compact tungsten powders.

SUMMARY OF INVENTION

The present invention treats difficult to compact tungsten starting powders with and acid treatment to enhance their propensity to form compacts at relatively low cold isostatic pressing pressures on the other of 18,000 to 20,000 lbs./sq. inch.

According to the process of the present invention, there is provided a process for forming a compact consisting essentially of pure tungsten metal powder by the steps of contacting a tungsten metal powder an aqueous acid mixture at a sufficient concentration and for a sufficient period of time to etch the surface of the powder. The tungsten powder is of the type that is normally difficult to compact at lower pressures. The acid comprises a mixture of hydrofluroic acid and hydrochloric acid. The resulting powder is isostaticly pressed at an ambient temperature and at a pressure of from about 18,000 to about 20,000 psi. for a sufficient period of time to form a compact.

DETAILED DESCRIPTION

The present invention uses starting powders of tungsten which are relative pure. Such powders are typically prepared by the hydrogen reduction of tungsten oxide powders. The starting powders are normally difficult to compact. Such powders have impurity levels on the order of less than about one percent by weight. Such powders preferably have a particle size of less than about 15 microns. More preferably the particle size is from about 4 to about 10 microns.

The relatively pure tungsten metal starting powder is contacted with an aqueous acid mixture at a sufficient concentration and for a sufficient period of time to etch the surface of the powder. It is also therorized that such treatment may dissolve fines present in the powder mixture which may deleteriously effect the strength of the subsequent compact. The aqueous acid mixture preferably comprises from about 5 to about 20 percent by weight hydrofluoric acid and from about 5 to about 10 percent by weight hydrochloric acid. The remaining portion consist of water. A preferred mixture consists of about 13 percent by weight hydrofluoric acid and about 7 percent by weight hydrochloric acid. In this case, acid washing times are on the order of 10 minutes. More dilute acid concentrations require longer times and more concentrated acid concentrations require less time.

It is preferable to precede and follow the acid wash with a water rinsing step. Preferably the powder is agitated when in contact with the aqueous acid solution so as to assure adequate contact of the solution with the powder. Prior to cold isostatic pressing, the powder is dried and deagglomerated.

The resulting tungsten powder is next isostaticly pressed into a blank at an ambient temperature at a pressure of from about 18,000 to about 20,000 psi. for a sufficient period of time to form a compact which has sufficient strength for further processing. After the powder has been compressed and ejected out of the mold, the compact exhibits no breakage or lamination.

EXAMPLE

The equipment utilized is a 50 Ksi isostatic press with a 4 inch diameter multi-cavity mold. Each cavity is approximately ½ inch diameter by about 2.5 inches long. Another single mold, a Plastisol molds, ⅞ inch by 7 inches long, is utilized in conjunction with 50/50 Plastisol pads which are ⅛ inch thick so that any deviations on different mold applications can be observed. M-55 tungsten powder, commercially available from the Chemical and Metallurgical Division, GTE Products Corporation, Hawes Street, Towanda, Pa. 18848, was filled into the Plastisol mold by hand and covered with plastic pads. The M-55 powder has a particle size of from about 4½ to about 5 microns. A rubber stopper and electric tape were utilized to prevent water infiltration. The sealed bag was lowered into the isostatic press which was brought to a pressure of 18 ksi and held for ten seconds. The pressure was then released to zero very slowly. The M-55 untreated powder could not produce a billet longer than one inch in length. The next batch of M-55 powder was treated with acid according to the following procedure prior to isostatic pressing. The sample was washed with deionized water, acid washer with a 13% HF, 7% HCl aqueous solution for 10 minutes. The powders were mechanically agitated during the washing and acid treatment steps. The resulting powder was dried for 16 hours and then isostaticly pressed as set forth above. The resulting billets were 7 inches long and had good strength for subsequent handling and exhibited no breakage or lamination. Similar results were observed when the 2.5 inch cavity mold was utilized using a similar procedure.

The particulate embodiments of the present invention being described, it is obvious to one of ordinary skill in the art to make various modifications and changes and proportions, temperatures, pressures and operative steps without departing from the spirit and scope of the present invention.

What is claimed is:

1. A process for forming a compact consisting essentially of pure tungsten metal powder by the steps of contacting a tungsten metal powder with and aqueous acid mixture at a sufficient concentration and for a sufficient period of time of etch the surface of said powder, said acid comprises a mixture of hydrofluroic acid and hydrochloric acid, and isostaticly pressing said powder at an ambient temperature at a pressure of from about 18,000 to about 20,000 psi. for a sufficient period of time to form a compact.

* * * * *

UNITED STATES PATENT AND TRADEMARK OFFICE

CERTIFICATE OF CORRECTION

PATENT NO. : 5,026,519

DATED : Jun. 25, 1991

INVENTOR(S) : Roselin E. Peralta, et al.

It is certified that error appears in the above-identified patent and that said Letters Patent is hereby corrected as shown below:

On the title page, item [75] should read as follows:

(75) Inventors: Roselin E. Peralta, Athens
James A. Giffen, Jr., Towanda
Robert C. Halliday, Towanda, all of PA

Signed and Sealed this

Seventeenth Day of November, 1992

*Attest:*

DOUGLAS B. COMER

*Attesting Officer*

*Acting Commissioner of Patents and Trademarks*